US006276404B1

(12) United States Patent
Birtcher et al.

(10) Patent No.: US 6,276,404 B1
(45) Date of Patent: Aug. 21, 2001

(54) CHEMICAL DELIVERY SYSTEM WITH SPILL CONTAINMENT DOOR

(75) Inventors: Charles Michael Birtcher, Valley Center; Thomas Andrew Steidl, Escondido; William J. Sheehy, Valley Center, all of CA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/661,750

(22) Filed: Sep. 14, 2000

(51) Int. Cl.[7] ..... B65B 1/04; B65B 3/04

(52) U.S. Cl. ..... 141/1; 141/83; 141/86; 222/111

(58) Field of Search ..... 141/1, 86, 83, 141/94; 222/108, 111

(56) References Cited

U.S. PATENT DOCUMENTS 5,950,693 9/1999 Noah et al. ..... 141/231
6,056,024 * 5/2000 Noah et al. ..... 141/21

OTHER PUBLICATIONS

Advertisement from Terra Universal, Inc., Chem. Carts A–F.
Advertisement of Schumacher for TransFill™ II–LRM.
Advertisement of Schumacher for TransFill™ II–TFL.
Advertisement of Victor Associates, Inc. of wheeled polypropylene container with reservoir.

* cited by examiner

*Primary Examiner*—Timothy L. Maust
(74) *Attorney, Agent, or Firm*—Geoffrey L. Chase

(57) ABSTRACT

A high purity chemical storage and delivery system and process with secondary containment, comprising; a cabinet for containing a canister of high purity chemical, a manifold in the cabinet for fluid connection between the canister and the cabinet for controllably dispensing high purity chemical; a control unit for controlling the dispensing of high purity chemical from the canister and the cabinet for a downstream use, a closeable opening in the cabinet for allowing loading and unloading of the canister from the cabinet, at least one door for closing the opening, a liquid tight secondary containment door in the opening for closing off a portion of the opening such that the secondary containment door is sized so that the portion is sufficient to define a volume in conjunction with the cabinet to contain the entire high purity chemical liquid contents of the canister.

20 Claims, 1 Drawing Sheet

CHEMICAL DELIVERY SYSTEM WITH SPILL CONTAINMENT DOOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention is directed to the field of high purity chemical storage and dispensing for the electronics fabrication industry.

In the fabrication of electronic components, it is frequently required to have various high purity chemicals in liquid or two phase liquid/vapor state contained in canisters of various sizes for supply to the fabrication processes or for cleaning.

It has become the industry norm to contain these canisters of high purity chemical in cabinets typically made of metal and having various automated features such as dispense, level signals and changeout signals for when a canister is empty or near empty.

Since many of the high purity chemicals are toxic, caustic or environmentally controlled, it is important to contain the chemicals in the cabinet to avoid inadvertent vapor discharge or liquid discharge. Historically, inadvertent vapor discharge has been addressed by having the cabinet vented to a house or factory-wide abatement system. However, a risk also prevails for liquid discharge from a failing canister or the connections between the canister and the downstream manifold in the cabinet.

Various trays or dollys with marginal lips or sidewalls are known in the industry to contain modest liquid leaks, such as the advertisement of Victor Associates, Inc. showing a side view of a wheeled polypropylene container with a reservoir for containing 20 gallons of liquid. Secondary containment around the reservoir is mentioned.

Various carts with spill containment are illustrated in the advertisement from Terra Universal, Inc. showing Chem Carts A. through F.

The advertisement of Schumacher for the TransFill II-LRM indicates that 110% spill containment is achieved. This spill containment is achieved by use of a fixed cabinet integral spill pan.

An advertisement by Schumacher for the TransFill II-TFL uses a caster mounted tray with short sidewalls to provide partial secondary containment.

U.S. Pat. No. 5,950,693 shows a cabinet with a transportation cart, FIG. 3, #300, holding a container of chemical. The cart is used to hold a majority of any spill, col. 6, line 50.

The industry has long sought a safe and effective way to store canisters of high purity chemical for dispensing in electronic industry fabrication, as well as other industries. Various partial secondary containments have been used to contain partial spills. Various carts and trays are known for such use. More significant containment has been taught, but it usually requires an inability to access or service the failing container or requires greater height than the typical industry standard cabinet requires. With expensive electronic fabrication floor space at a premium, the industry has long sought an economical space conserving way to contain potentially significant chemical spills from containers while still being able to access the failing container without further spilling leaked liquid chemical and without changing the "footprint" of the cabinet storing the container in the fab.

The present invention addresses the above recited shortcomings of the prior art and succeeds in providing complete secondary containment without increased cabinet height and without elaborate additional carts or trays, as will be set forth in greater detail below.

BRIEF SUMMARY OF THE INVENTION

The present invention is a high purity chemical storage and delivery system with secondary containment, comprising; a cabinet for containing a canister of high purity chemical, a manifold in the cabinet for fluid connection between the canister and the cabinet for controllably dispensing high purity chemical; a control unit for controlling the dispensing of high purity chemical from the canister and the cabinet for a downstream use, a closeable opening in the cabinet for allowing loading and unloading of the canister from the cabinet, at least one door for closing the opening, a liquid tight secondary containment door in the opening for closing off a portion of the opening such that the secondary containment door is sized so that said portion is sufficient to define a volume in conjunction with the cabinet to contain the entire high purity chemical liquid contents of the canister.

The present invention is also a process for containing the entire contents of a high purity chemical canister in a cabinet, comprising; providing a cabinet for containing a high purity chemical canister with an opening for a canister, providing a canister containing a high purity chemical at least partially in a liquid physical state, providing a liquid tight secondary containment door in the opening for closing off a portion of the opening such that the secondary containment door is sized so that the portion is sufficient to define a volume in conjunction with the cabinet to contain the entire high purity chemical liquid contents of the canister, and in the event of liquid high purity chemical leaking from the canister when in the cabinet, retaining leaking liquid high purity chemical in the cabinet by liquid tight engagement of the secondary containment door to the cabinet.

DETAILED DESCRIPTION OF THE INVENTION

Figure 1:
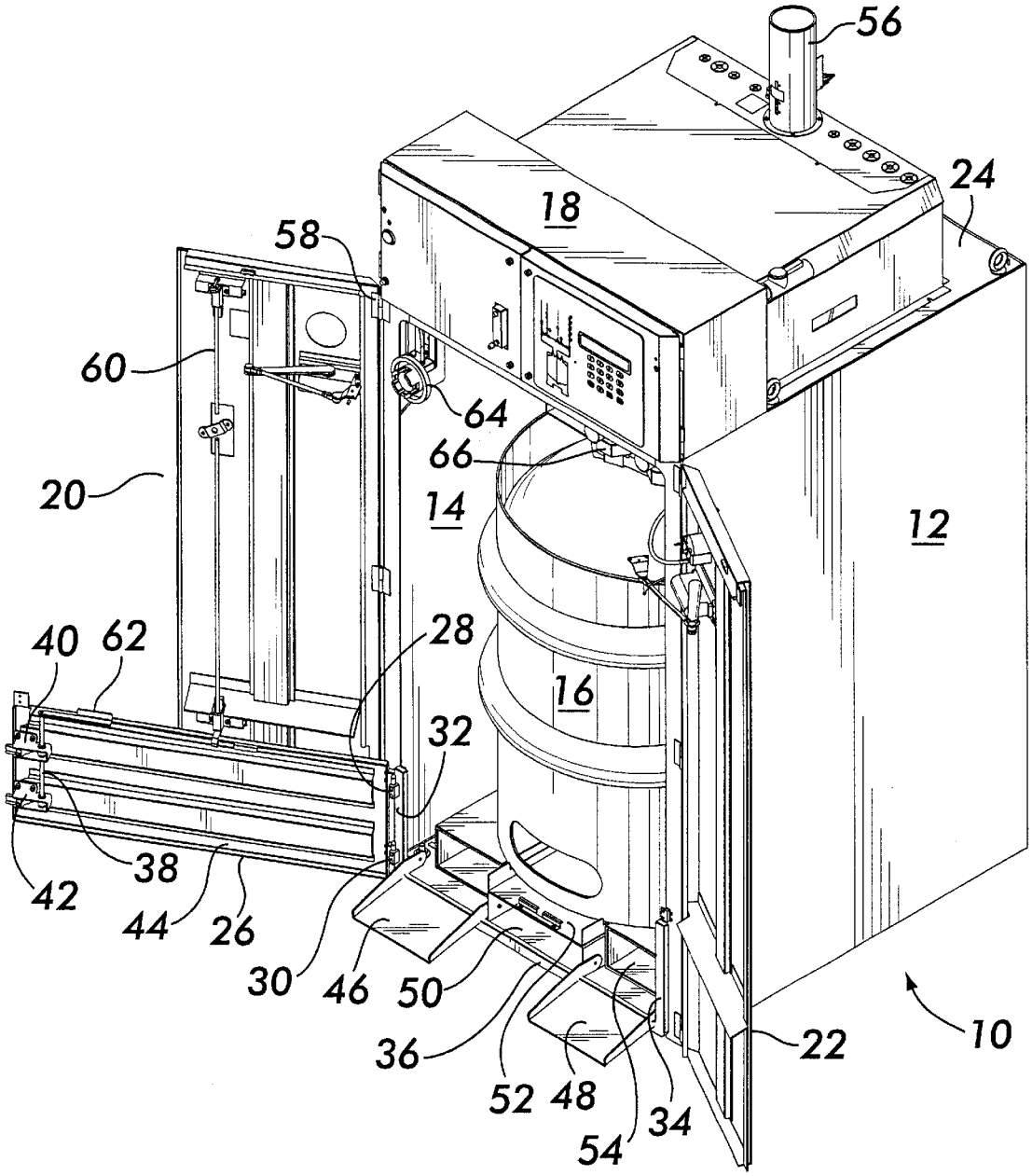
FIG. 1 is a prespective view of a preferred embodiment of the present invention.

The present invention is an apparatus or system for storing high purity chemicals such as tetraethylorthosilicate (TEOS), alkyl silanes, dichloroethylene, trimethylborate (TMB), trimethylphosphite (TMPI), boron-phosphorus-silicon glass (BPSG) and others used by the electronic fabrication industry.

The present invention provides secondary spill containment for liquid contained in a canister stored in a cabinet designed for storage and automatic or manual dispensing of chemical contained in the canister for use at an electronic fabrication factory or other chemical raw material consuming operation.

Preferably, the present invention provides secondary spill containment for the entire liquid content of a canister. More preferably, the present invention provides a safety margin for containment in excess of the content of a chemical containing canister. This could be 110% by volume containment of the liquid content of such a canister.

Additionally, the present invention provides a design so that in the event of a chemical spill of liquid from the canister, an operator could open the cabinet to assess the extent of the spill condition without leaking chemical and the operator could service the canister or access the spilled chemical for potential recovery or removal.

It is important in any secondary containment device to provide a mechanism which does not interfere with the normal changeout of a chemical canister, in light of the fact that typically canister changeout occurs frequently or systematically, and the need for secondary containment of spilled liquid chemical is an isolated, accidental occurrence.

The present invention provides a hinged door which closes off the lower portion of a high purity chemical storage and dispense cabinet in a liquid-tight sealing condition. This liquid tight secondary containment door is in addition to the normal door or doors which provide access to the interior of the cabinet where the canister is normally stored during operation.

The secondary containment door has a gasket which seals liquid tight with the frame of the front of the cabinet. The sealing engagement is achieved by the use of a locking device to hold the secondary containment door in the liquid tight sealed condition. The gasket can be any of the typical gasket materials which are compatible with the chemical being stored and can include; Teflon® products, polyvinyl chloride materials, various polybutylene rubbers, Kalrez® materials, Chemraz® materials, Viton® materials, EPDM® materials, Neoprene® material, Aflas® materials, silicone rubber and similar elastomers. The locking mechanism can be any of a number of latch mechanisms, including; a running bolt, a spring biased latch, etc.

The secondary containment door is preferably contained inside the normal door or doors of the cabinet. The secondary containment door is preferably hinged to one side of the front frame of the cabinet by one or more hinges, but it is also conceivable to hinge the door by what is known as a continuous "piano" hinge or fastening by other mechanisms such as a slotted track or bolt and nut fastening.

The secondary containment door is typically made from carbon steel which can be painted in a durable chemical resistant coating or paint. Alternatively, the door could be made of out any material capable of meeting local fire codes, such as a one hour fire rating, or the door could be 316 stainless steel.

The present invention will now be described with reference to a preferred embodiment illustrated in FIG. 1.

A cabinet 10 for containing a canister 16 of high purity chemical, such as TEOS, is shown in FIG. 1. The cabinet has side walls 12 and 14, a floor 50, a top 24 and a back wall which is not shown. The cabinet 10 is designed to be relatively gas tight against leaking externally in cooperation with a slightly negative internal pressure, to contain the high purity chemical for environmental and safety reasons, by the cabinet 10 being vented by exhaust duct 56, preferably to a house abatement system, which are typically provided in factories, such as electronic fabrication factories (fabs). Such abatement systems are typically designed to treat the entire waste and effluent from the chemical processes occurring in a fab.

The cabinet 10 has a opening defined by sidewalls 12 and 14 and top and bottom 24 and 50, which is closed off by relatively gas tight (against leaking externally) doors 20 and 22. These doors are preferably hinged to the sidewalls 12 and 14 by hinges, one of which is illustrated as hinge 58. Each door would have a locking mechanism 60 which engages at least the top 24 of the cabinet, but preferably the top 24 and the bottom 50 by appropriate latching. The locking mechanism is actuated by an appropriate latch, knob or key cylinder on the front exterior of the door 20, not illustrated.

The canister 16 is mounted on a fork lift accommodating skid 54, which is facilitated by two hinged ramps 46 and 48, which facilitate the loading or unloading of the canister 16 in the cabinet 10.

The canister 16 is hooked up to high purity chemical fluid connection to the cabinet by manifold 66, partially illustrated and typically comprising an array of piping and valves which provides for the functions of controllable delivery of high purity chemical from the canister 16 to the cabinet 10 and downstream delivery from the cabinet 10, not illustrated. Pressurizing gas, purge cycles and clean out are also contemplated for the manifold 66, as typically required in the industry. Additionally, an emergency shut down switch an/or valve 64 is provide so that an operator can shut down the unit in the event of a power outage or upset condition. Switch and/or valve 64 is contemplated for local actuation. Switch and/or valve 64 projects through the door 20 when the latter is closed in a fluid tight sealing manner to facilitate access by an operator without opening the cabinet 10.

Control of the cabinet 10, the manifold 66 and the dispensing or shut down of the system is maintained by control unit 18, which can be a process controller, onboard computer or a basic electronic mechanism controlled by a remote computer or operator. Appropriate controls, switches and keyboard are typically mounted on the face of the control unit 18, as well as a system status electronic diagram or liquid crystal display, showing current process functioning.

Although high purity chemical content in the canister 16 can be determined by any number of ways typical in the industry, such as internal sensors of floats, capacitance or optical probes, or external sensors, such as ultrasonic sensors, it is preferred to mount the skid 54 and canister 16 on a scale 52 to determine high purity chemical content by weight, typically tared weight.

Spill detection in the cabinet can be electronically monitored and communicated to the control unit 18 or remotely to the operator or a central computer by sensing devices typical to the industry, such as; photo-optic sensors, Brewster angle photo optic sensors or float level sensors.

The spill detection probe is made up of an IR diode/phototransistor pair assembled with a quartz rod.

The components are installed with the optic ends facing the end of a quartz rod. The rod has a flat surface at the end where the optoelectronics are installed.

The other end of the rod is cone shaped. The probe is installed perpendicular to the bottom of the cabinet with the cone end facing down.

When the quartz cone is dry., the IR diode radiates into the quartz rod. Most of the lightwaves bounce off the inner surfaces of the end and travel back up into the quartz rod, exposing the phototransistor to the light.

This turns the phototransistor on, applying power to its emitter. A comparator circuit on the cabinet controller is connected to the phototransistor emitter through the backplane and circular connectors on the bottom of the electronics enclosure.

The output of the comparator circuit changes state when the voltage on the emitter is greater than the reference voltage at the comparator's other input.

When liquid is present at the quartz cone tip, the index of refraction of the quartz changes, allowing most of the infrared light to pass through the end out of the rod. The transistor consequently turns off, and no potential is applied to the input to the comparator circuit. The comparator has front-end pull-down resistors, which give rise to a zero voltage input.

The secondary containment door 26 comprises a single hinged door which spans the entire lower portion of the opening of the cabinet 10 from one side 14 to the other side 12. Although it is possible to have two interacting doors, the single door is easier to make liquid tight.

The secondary containment door 26 is hinged to side 14 by hinges 28 and 30, although it is contemplated that the door 26 could be connected to the cabinet by a "piano" hinge or other openable mechanisms. The non-hinged end of the door 26 is fitted with two latches 40 and 42 which operate as a fastener, which engages the side 12 of the cabinet. Latches 40 and 42 are simultaneously actuated by actuation axle 38 which also engages operator handle 62.

The secondary containment door 26 has a sealing edge 44, which can be a gasket of a silicon rubber material which deforms against cabinet edges 32, 34 and 36 to form a liquid tight sealing surface.

The secondary containment door is preferably sized to have a height such that when engaged against the side walls 12 and 14 and floor 50, it defines a volume in the base of the cabinet 10 of sufficient size to contain the entire liquid content of the stored canister 16, and preferably in excess of such content so as to provide a margin of safety. Preferably, the door 26 is sized to contain 110% by volume of the rated capacity of the largest canister 16 the cabinet 10 is designed to accommodate.

The canister 16 is typically 316 stainless steel or other corrosion resistant metal. The canister could be aluminum, glass, or a Teflon coated container of any construction, including plastic.

The cabinet 10 including sidewalls 12 and 14, top and bottom 24 and 50, doors 20 and 22 and secondary containment door 26 are typically coated carbon steel sheet material, but they could be plastic or 316 stainless steel or aluminum.

The system operates by loading a canister 16 into the cabinet 10 typically by a powered or hand held forklift or pallet jack engaged in the skid 54. The ramps 46 and 48 facilitate a forklift loading the canister 16 mounted skid 54 into the cabinet 10. The ramps 46 and 48 are then raised or pivoted up in a closed position. Secondary containment door 26 is closed and latched or locked. The cabinet doors 20 and 22 are also closed and latched or locked after connecting the canister 16 for fluid flow to the manifold 66 which provides pressurizing gas, bubbling or vacuum dispensing of the high purity chemical from the canister 16 through the manifold 66 to a downstream fab use, as dictated by the control unit 18. In an upset condition, canister 16 may leak all or a part of its liquid high purity chemical content into the base of the cabinet 10, but this liquid will be contained by the secondary containment door 26 which is in liquid tight sealing condition with the front frame of the cabinet 10 opening. This allows only the surfaces of the secondary containment door 26 to be engineered to a tight dimension to create the liquid tight seal and only the gasket 44 of the door 26 to be designed for liquid contact. The doors 20 and 22 can be less rigorously designed and their sealing engagement need only be designed for fluid engagement and material compatibility. By use of the secondary containment door 26 which only seals a part of the opening of the cabinet 10, an operator is able to open doors 20 and 22 to inspect the condition of the interior of the cabinet and any upset condition and potentially service the canister 16 or cabinet 10 without fear of spilling leaked liquid chemical out onto the fab floor. By using a latched and hinged secondary containment door, the cabinet allows an operator to readily load and unload the cabinet to changeout canisters without compromising the secondary containment feature. Ease of operation and protection from liquid spills are addressed by the present invention to overcome the problems in prior art storage and dispensing systems.

The present invention has been set forth with regard to one preferred embodiment, but the full scope of the present invention should be ascertained from the claims which follow.

What is claimed is:

1. A high purity chemical storage and delivery system with secondary containment, comprising; a cabinet for containing a canister of high purity chemical, a manifold in said cabinet for fluid connection between said canister and said cabinet for controllably dispensing high purity chemical; a control unit for controlling the dispensing of high purity chemical from said canister and said cabinet for a downstream use, a closeable opening in said cabinet for allowing loading and unloading of said canister from said cabinet, at least one door for closing said opening, a liquid tight secondary containment door in said opening for closing off a portion of said opening such that said secondary containment door is sized so that said portion is sufficient to define a volume in conjunction with said cabinet to contain the high purity chemical liquid contents of said canister.

2. The system of claim 1 wherein said secondary containment door is hingedly connected to said cabinet.

3. The system of claim 1 wherein said secondary containment door has a gasket which sealably engages said cabinet when said secondary containment door is closed.

4. The system of claim 1 wherein said secondary containment door has a fastener for locking said secondary containment door in a closed position in said cabinet.

5. The system of claim 1 wherein said secondary containment door is inside said at least one door.

6. The system of claim 1 wherein said at least one door is a pair of hingedly connected doors which entirely close off said opening in said cabinet.

7. The system of claim 6 wherein said pair of hingedly connected doors have a fluid tight seal with said cabinet.

8. The system of claim 1 wherein said cabinet has a canister connected to said manifold.

9. The system of claim 8 wherein said canister is sized for up to 220 liters of high purity chemical.

10. The system of claim 1 wherein the floor of said cabinet has at least one hinged ramp for loading or unloading said canister in said cabinet.

11. The system of claim 10 wherein there are two hinged ramps.

12. The system of claim 1 wherein said cabinet has a scale mounted in a floor of said cabinet for providing a signal of the canisters content of said high purity chemical to said control unit.

13. The system of claim 1 wherein said cabinet has a fluid exhaust conduit in a top of said cabinet to remove fluid high purity chemical from said cabinet for downstream abatement.

14. The system of claim 1 wherein said cabinet has a shutoff valve to discontinue fluid flow from a canister in said cabinet connected to said manifold.

15. The system of claim 1 wherein said secondary containment door is sized so that said portion is sufficient to define a volume in conjunction with said cabinet to contain 110% by volume of the high purity chemical liquid contents of said canister.

16. A process for containing the entire contents of a high purity chemical canister in a cabinet, comprising; providing a cabinet for containing a high purity chemical canister with an opening for a canister, providing a canister containing a high purity chemical at least partially in a liquid physical state, providing a liquid tight secondary containment door in said opening for closing off a portion of said opening such that said secondary containment door is sized so that said portion is sufficient to define a volume in conjunction with said cabinet to contain the high purity chemical liquid contents of said canister, and upon the leaking of liquid high purity chemical from said canister when in said cabinet, retaining leaking liquid high purity chemical in said cabinet by liquid tight engagement of said secondary containment door to said cabinet.

17. The process of claim 16 wherein said secondary containment door contains 110% by volume of a high purity chemical liquid content of said canister in conjunction with said cabinet.

18. The process of claim 16 wherein a signal is communicated to a control unit on said cabinet in the event liquid high purity leaks from said canister in said cabinet.

19. The process of claim 16 wherein said secondary containment door forms a liquid tight seal with said cabinet using a gasket.

20. The process of claim 16 wherein said secondary containment door lockably closes against said cabinet.

* * * * *